US007905063B2

(12) United States Patent
Kelly

(10) Patent No.: US 7,905,063 B2
(45) Date of Patent: Mar. 15, 2011

(54) DOUBLE ANCHOR AND LIFTING SHACKLE FOR CONCRETE SLABS

(75) Inventor: David L. Kelly, Sacramento, CA (US)

(73) Assignee: MMI Products, Inc., Atlanta, GA (US)

( * ) Notice: Subject to any disclaimer, the term of this patent is extended or adjusted under 35 U.S.C. 154(b) by 175 days.

(21) Appl. No.: 12/231,576

(22) Filed: Sep. 3, 2008

(65) Prior Publication Data

US 2010/0011678 A1 Jan. 21, 2010

Related U.S. Application Data

(60) Provisional application No. 61/135,070, filed on Jul. 15, 2008.

(51) Int. Cl.
*E02D 35/00* (2006.01)

(52) U.S. Cl. ..... 52/125.5; 52/125.1; 52/125.6; 52/701; 52/707

(58) Field of Classification Search ..... 52/125.5, 52/122.1, 125.1, 125.2, 125.3, 125.6, 701, 52/707, 699; 294/1.1, 82.1
See application file for complete search history.

(56) References Cited

U.S. PATENT DOCUMENTS

| | | | | |
|---|---|---|---|---|
| 361,927 | A | 4/1887 | Cartwright | |
| 956,938 | A | 5/1910 | Lewis | |
| 2,886,370 | A | 5/1959 | Liebert | 294/89 |
| 3,883,170 | A | 5/1975 | Fricker et al. | 294/83 |
| 4,173,856 | A | 11/1979 | Fricker | 52/125 |
| 4,367,892 | A | 1/1983 | Holt | 294/75 |
| 4,627,198 | A | 12/1986 | Francies, III | 52/125.5 |
| 4,930,269 | A | 6/1990 | Kelly et al. | 52/125.5 |
| 5,155,954 | A * | 10/1992 | Roire | 52/125.5 |
| 5,244,243 | A * | 9/1993 | Grayson et al. | 294/89 |
| 5,588,263 | A | 12/1996 | Kelly et al. | 52/125.4 |
| D392,752 | S | 3/1998 | Kelly et al. | D25/133 |
| 6,142,546 | A * | 11/2000 | Hansort | 294/89 |
| 6,513,847 | B2 | 2/2003 | Harris et al. | 294/81.6 |
| 6,647,674 | B1 * | 11/2003 | Lancelot et al. | 52/125.4 |
| 6,688,049 | B2 | 2/2004 | Sanftleben et al. | 52/125.4 |
| 6,769,663 | B2 | 8/2004 | Kelly et al. | 249/91 |
| 7,127,859 | B2 * | 10/2006 | Domizio | 52/576 |
| 2006/0248811 | A1 * | 11/2006 | Hansort | 52/122.1 |

* cited by examiner

*Primary Examiner* — Basil Katcheves
*Assistant Examiner* — Branon C Painter
(74) *Attorney, Agent, or Firm* — Dergosits & Noah LLP

(57) ABSTRACT

A lifting mechanism for a concrete structure is provided through means of a void former and anchor assembly which it cast in place to provide an accurate recess in the structure having two or more spaced divergent anchors therein. The anchors define annularly aligned apertures within the recess. A lifting shackle of an arcuate configuration complimental with that of the recess is received within the recess and carries an arcuate locking bolt extendable through the aligned apertures.

8 Claims, 6 Drawing Sheets

DOUBLE ANCHOR AND LIFTING SHACKLE FOR CONCRETE SLABS

RELATED APPLICATION

This application is based upon and claims the benefit of Provisional Application 61/135,070, filed Jul. 15, 2008.

BACKGROUND OF THE INVENTION

1. Technical Field

The present invention relates to a dual anchor assembly for embedment in concrete slabs and to a lifting shackle adapted to simultaneously engage the multiple anchors of the assembly. In its more particular aspects, the invention is concerned with a void former which provides for positioning and placement of the anchors and forms an arcuate recess in the slab in intersecting relationship with the anchors. It is also concerned with an anchor assembly and hoisting shackle of increased load capacity, as compared to existing assemblies and shackles which employ single anchors.

2. Description of the Prior Art

The prior art relating to the present invention is typified by U.S. Pat. Nos. 3,883,170 and 4,367,892. These patents show single anchor assemblies for embedment in concrete slabs and associated releasable lifting shackles for engagement with the anchors. They also teach the provision of an arcuate recess around the end of the anchor engaged by the shackle. The '892 patent, in particular, teaches a void former for forming the recess and placing the anchor.

It is also known in the prior art to provide anchor assemblies for embedment in concrete slabs, wherein the anchors have divergent portions to spread the load and resist pullout. Such a device, for use with a releasable lifting shackle, may be since in U.S. Pat. No. 4,173,856. In the device of that patent, however, each shackle engages only a single anchor.

SUMMARY OF THE INVENTION

The hoisting shackle of the invention comprises a ring-shaped body having a hollow toroidal portion with slots extending thereacross at spaced locations and an arcuate locking bolt slidably received within the toroidal portion for select extension across the slots and through anchors received within the slots.

The invention also provides an anchor assembly for embedment within a concrete slab to place a pair of anchors within the slab and form a void therearound.

The anchor assembly comprises a void former having a generally arcuate lower surface. At least two grooves are formed in and opening through the arcuate surface in annually spaced relationship to one another. Anchors are received within the grooves and extend laterally from the void former. Internally of the void former, the anchors provide annually aligned openings.

The concrete structure and lifting mechanism of the invention provide an arcuate recess within the concrete structure, a pair of anchors embedded within the structure and extending into the recess, and a releasable shackle complimentally received within the recess and engaged with the anchors.

The invention also provides a method for lifting a concrete structure wherein two or more anchors are embedded within the structure in divergent relationship and a ring-shaped lifting shackle is simultaneously engaged with the anchors.

A principal object of the invention is to provide an increased load capacity hoisting shackle having a quick release mechanism engagable with two or more anchoring elements embedded within a concrete structure.

Another and related object is to provide such a hoisting shackle which is not larger than existing shackles used with single anchoring elements.

Still another object of the invention is to provide a hoisting shackle and anchor combination for use in lifting concrete structures, wherein the load is divided into two parts to reduce the stress level within the shackle.

Yet another object of the invention is to provide an improved lifting anchor system for use in a relatively shallow concrete structure, which provides a wider spread of lifting forces within the structure.

A further object of the invention is to provide an anchor system for use in relatively a narrow concrete wall, which provides a wider spread of forces when pulled in the plane of the wall.

Another object of the invention is to provide the anchor system for use in narrow walls, wherein lifting forces are perpendicular to the plane of the wall and a wider lifting force sheer plate is provided within the wall.

Another object is to provide an anchoring system and lifting shackle for use in a deep mass concrete structure, which spreads the overall stresses within the structure and reduces the stresses within the shackle.

These and other objects will become more apparent from the following detailed description and accompanying drawings.

DESCRIPTION OF THE PREFERRED EMBODIMENTS

Figure 1:
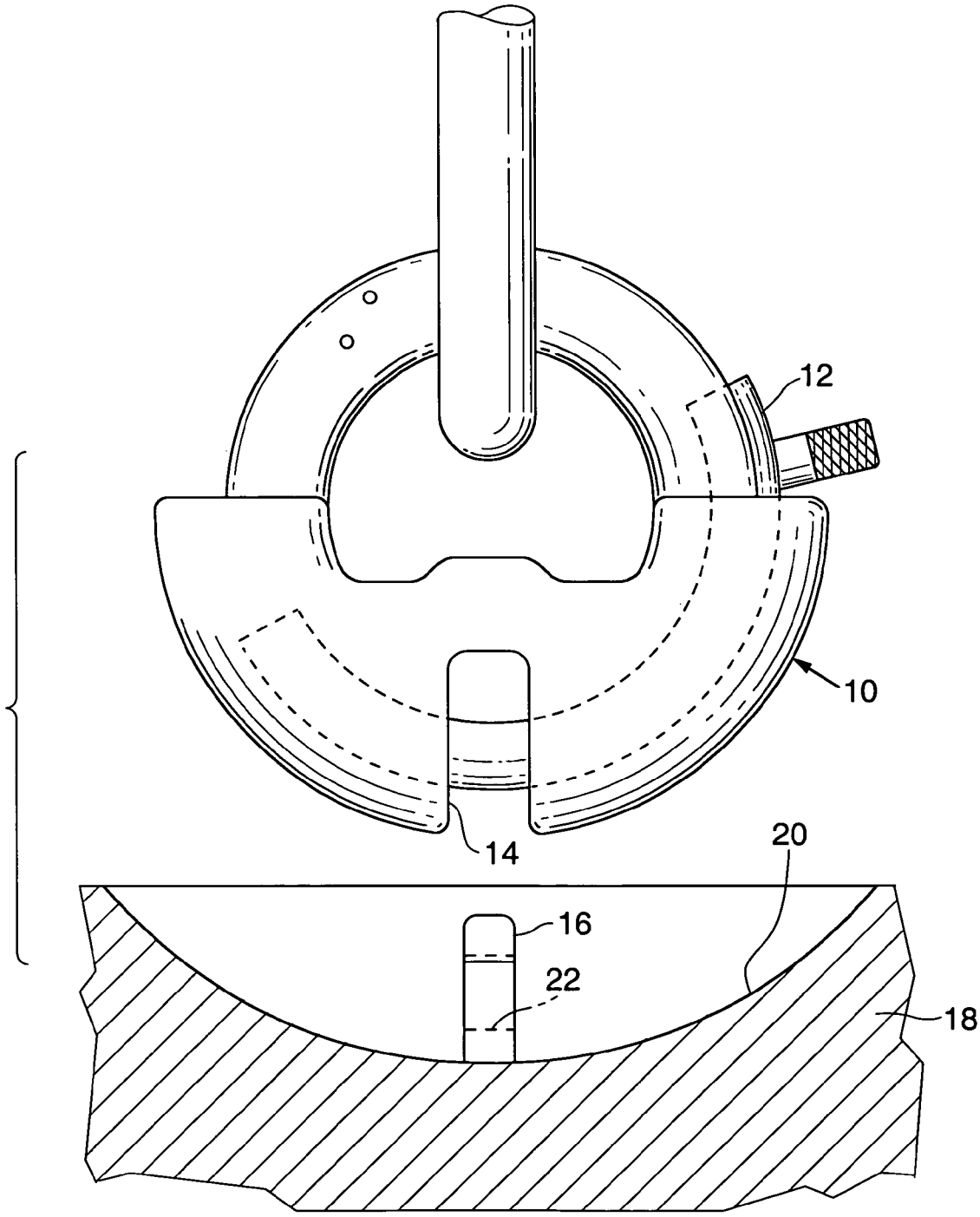
FIG. 1 (PRIOR ART)
FIG. 1 is an elevational view of the prior art lifting shackle of U.S. Pat. No. 3,883,170, showing the single anchor with which the shackle is used embedded within a concrete structure.

FIG. 1 illustrates the prior art releasable lifting shackle of U.S. Pat. No. 3,883,170. The shackle comprises a cast steel shackle body 10 having a hollow toroidal cavity formed therein which carries an arcuate locking bolt 12. The bottom of the shackle body 10 is formed with a slot 14 for receipt of an apertured anchor 16 embedded in a concrete structure 18. A generally arcuate recess 20 is formed in the concrete structure around the anchor 16.

In operation, the anchor 16 is received within the slot 14, with the bolt 12 removed from the slot, and the bolt is then extended across the slot and through an aperture 22 formed in the anchor 16. In this condition, the shackle is securely engaged with the anchor 16 and lifting force may be imparted to the concrete structure through the shackle.

Figure 2:
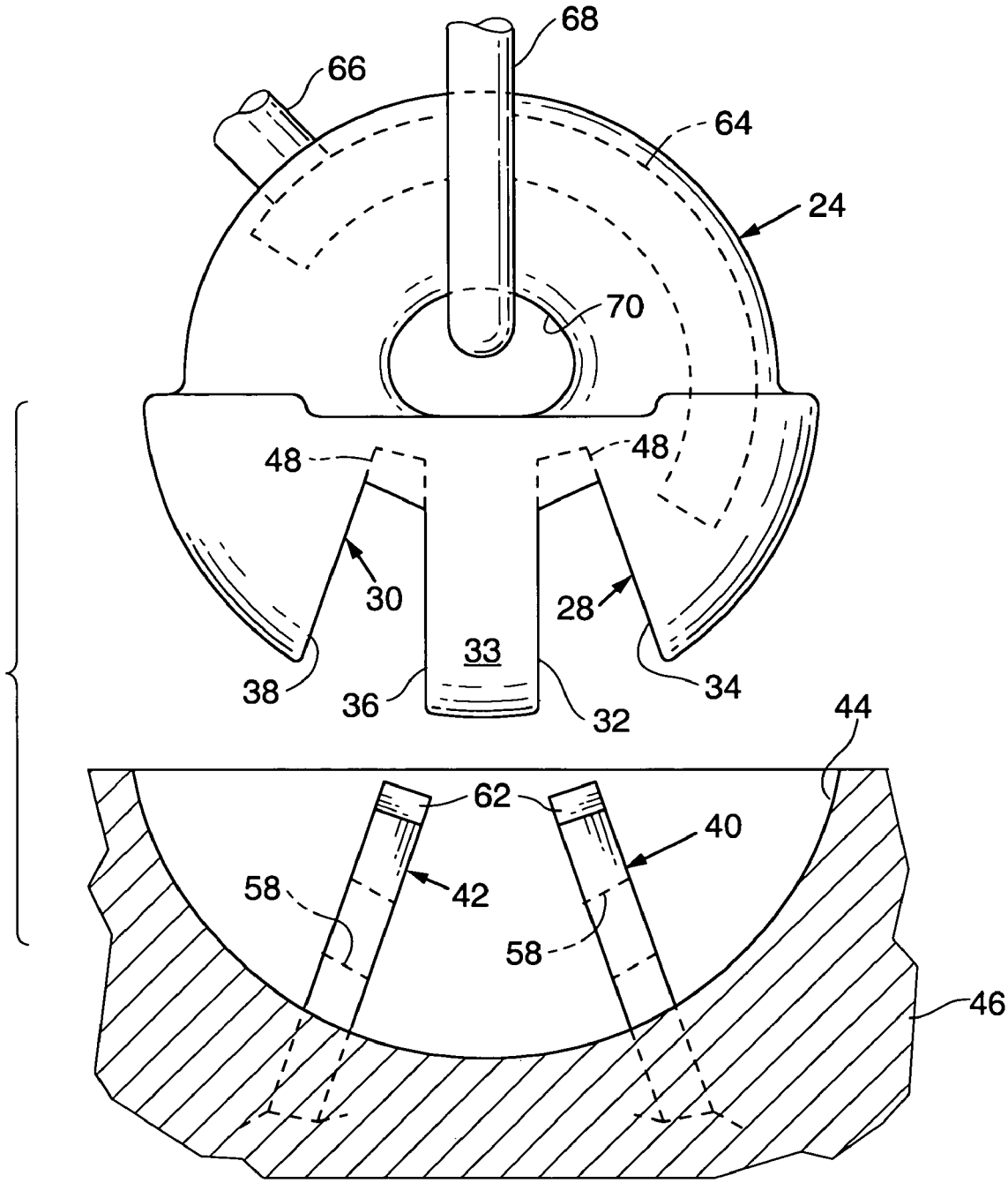
FIG. 2 is an elevational view of the lifting shackle of the present invention and the associated dual anchor embedded within a concrete structure.
Figure 3:
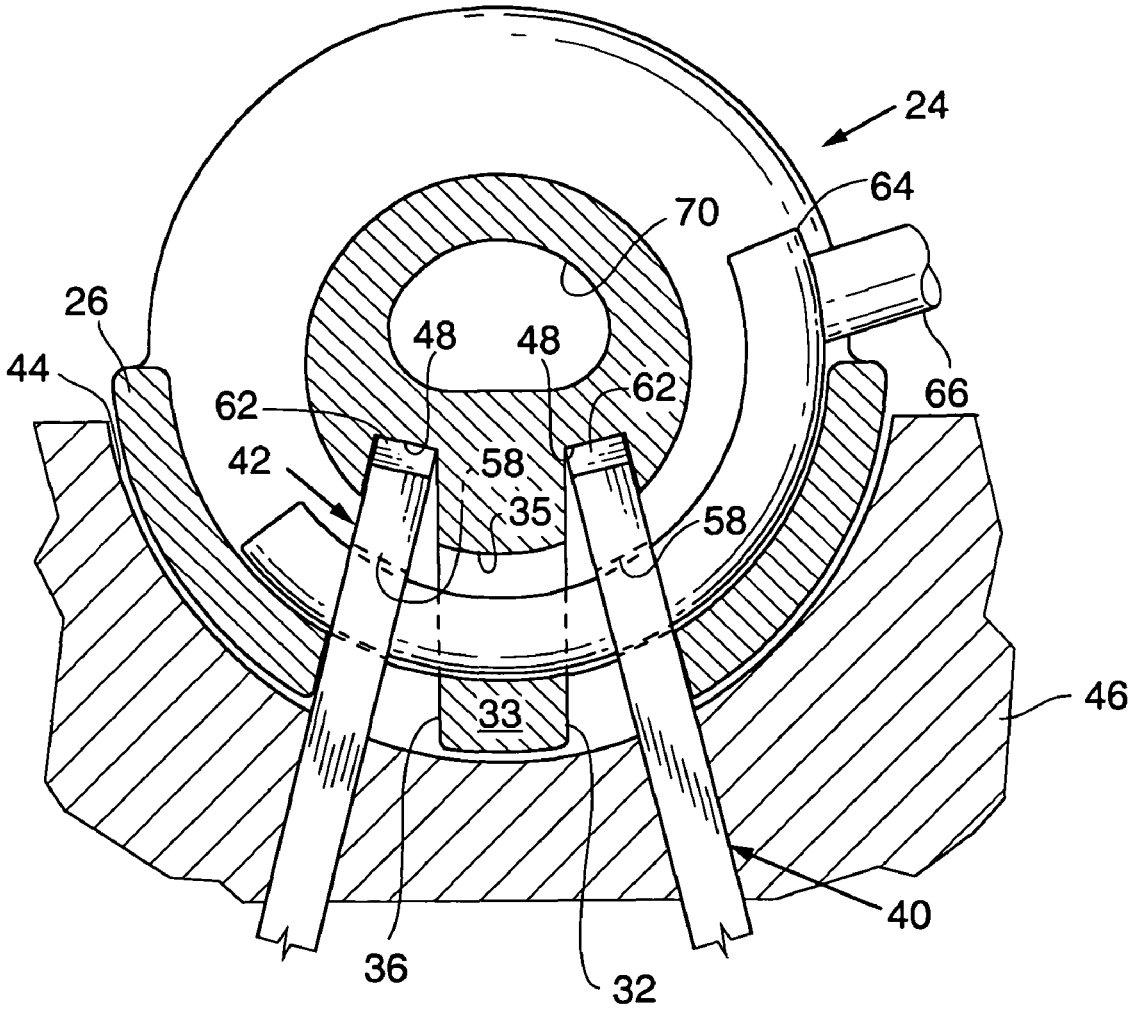
FIG. 3 is a cross-sectional elevational view of the lifting shackle shown in FIG. 2.

The shackle of the present invention in seen in FIGS. 2 and 3 wherein the steel shackle body is designated, in its entirety, by the numeral 24. The body 24 has an annular cavity 26 which is open to the outside in the upper half of the body. The upper half of the body is thus an open U-shaped cross-section. The bottom of the body is of a closed U-shaped configuration and formed with a pair of generally trapezoidal slots 28 and 30 extending thereacross. Slot 28 has a vertical wall 32 and an outwardly divergent wall 34. Slot 30, similarly has a vertical wall 36 and an outwardly divergent wall 38. This arrangement enables the shackle to move vertically into engagement with a pair of anchors 40, 42 cast in place within an arcuate recess 44 formed in the concrete structure 46 to be lifted. Such movement can be appreciated from a comparison of FIGS. 2 and 3 wherein, in FIG. 2, the shackle is above the recess and in FIG. 3 is received within the recess. A support section 33, forming an integral part of the shackle body, is disposed between the slots 28. A throughbore 35 extends fully through and across the section 33.

The angle of the divergent walls 34, 38 is chosen to compliment the angle at which the anchors 40, 42 are set. The preferred range of angles, as measured from vertical, is between 10 and 35 degrees. When the anchors are received within the slots, the outer surfaces of the anchors engage the divergent surfaces. Complimental engagement of the anchors with the shackle also occurs through means of sockets 48 formed in the shackle body at the ends of the slots 28, 30. These sockets are of a generally trapezoidal configuration corresponding to that of the ends of the anchors 40, 42.

Figure 5:
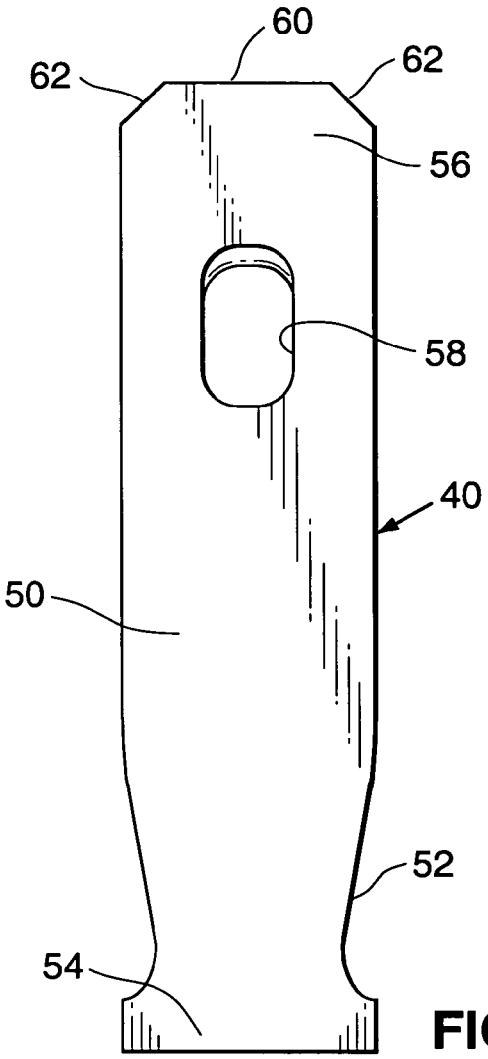
FIG. 5 is an elevational view of one of the bar anchors shown in FIG. 3.

The anchors 40, 42 are of identical configuration and are of each "bar" type. Their configuration can best be appreciated from FIG. 5 where it will be seen that each anchor comprises:

- an elongate body 50;
- a convergent/divergent proximal portion 52;
- a foot 54; and
- a distal portion 56 having an elongate aperture 58 formed there through.

The top of the distal portion 56 has a flat upper surface 60 and tapered side surfaces 62. The upper surface 60 and side surfaces 62 form a generally trapezoidal configuration generally complimental to the sockets 48 formed in the shackle body 24.

The basic structure of the inventive shackle is completed by an arcuate locking bolt 64 slidably received within the shackle body 24 for movement between the open condition shown in FIG. 2 and the closed condition shown in FIG. 3. The bolt extends through approximately 180° of the circumference of the shackle body and, when unloaded, is freely movable therein. The throughbore 35 is of an arcuate configuration complimental to that of the bolt 64 and so proportioned and positioned as to enable the bolt to extend freely therethrough, when unloaded. When loaded, lifting forces imparted to the bolt by anchors 40, 42 are transmitted to and carried by the lower interior surface of the throughbore 35 and the lower interior surfaces of annular cavity 26. A handle 66 extends through the open slotted top of the shackle body to enable the bolt to be manually moved between the open and closed conditions.

As shown in FIG. 2, a closed link 68 extends through a generally centrally disposed opening 70 formed through the shackled body 24. The link would be secured to a lifting hoist (not illustrated).

The operation of the lifting shackle can be appreciated from a comparison of FIGS. 2 and 3. In FIG. 2, the shackle is about to be lowered into receiving engagement with a pair of anchors embedded within the concrete structure. During this lowering process, the vertical walls 32, 36 of the shackle body pass between the anchors 40, 42. Ultimately, the ends of the anchors complimentally nest within the sockets 48 and the outer surfaces of the anchors complimentally engage the divergent walls 34, 38 of the shackle body. The later condition is shown in FIG. 3.

Once the shackle body is fully engaged over the anchors, the locking bolt 64 is moved annularly within the body and extended through the throughbore 35 of the section 33 and the apertures 58 of the anchors, as shown in FIG. 3. This serves to both secure the shackle to the anchors and to maintain the outer surface of the shackle in complimental engagement with the inner surface of the arcuate recess 44.

Figure 4:
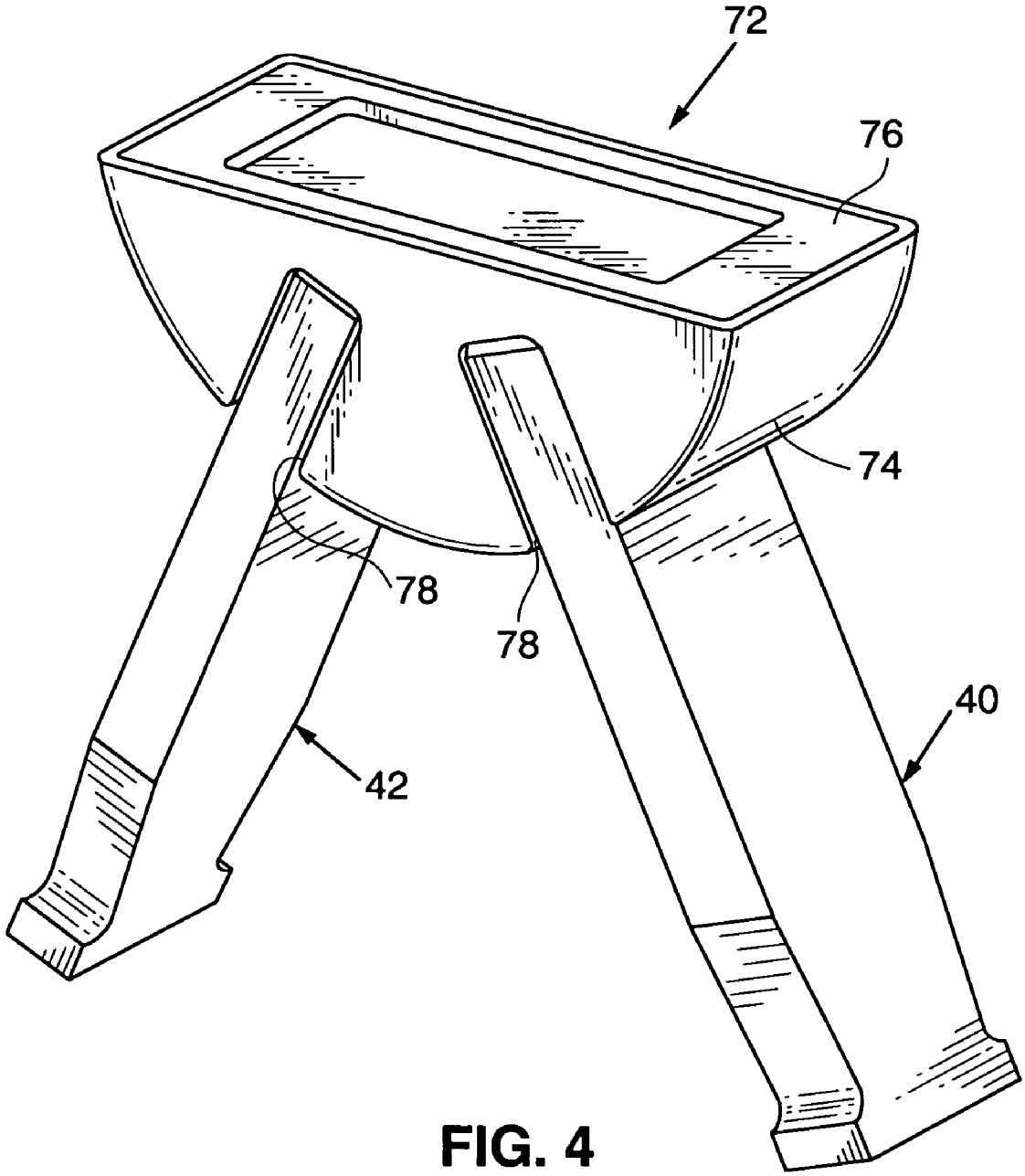
FIG. 4 is a perspective view of the void former of the invention, with bar anchors shown in place within the void former.

FIG. 4 shows a void former 72 for positioning the anchors 40, 42 within a concrete structure, as the structure is being formed, and creating an arcuate recess within the surface of the structure. The void former 72 is fabricated from a relatively strong resilient material, such as rubber or polymer. The lower surface 74 of the void former is of arcuate configuration corresponding to that of the recess 44 to be formed within the concrete structure. The upper surface 76 is generally flat and may have a recess formed therein for the attachment of placement hardware. Grooves 78 extend the cross and open through the lower surface 74 of the void former, for receipt of the anchors 40, 42. These grooves are proportioned for snug receipt of the anchors and are disposed to position the anchors at the desired inclination within the body of the concrete structure being formed. Protrusions 80 within the grooves 78 are provided for engagement with the apertures 58 of the anchors.

In use, the void former is positioned within the form for the concrete structure and concrete is then poured around the void former and anchors, to the level of the upper surface 76 of the void former. Removable pedestals (not illustrated) may be secured to the feet 54 to support the anchors. Once the concrete has sufficiently cured, the void former is removed, thus leaving an annular 44 recess formed in the surface of the concrete structure, with the anchors 40, 42 extending into the recess.

Figure 7:
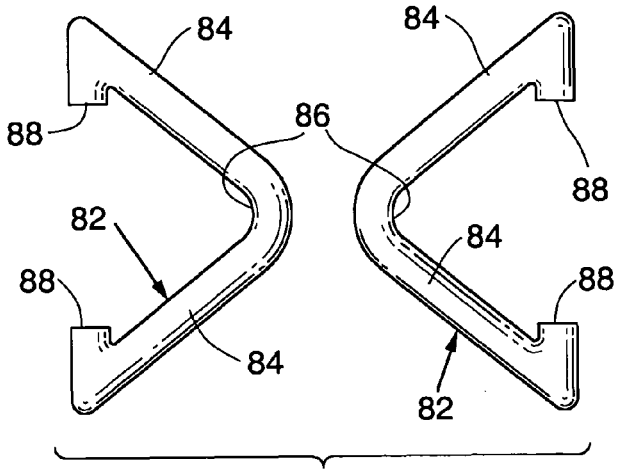
FIG. 7 is a plan view of a pair of wire anchors positioned relative to one another, as they would appear in practice of the present invention.
Figure 8:
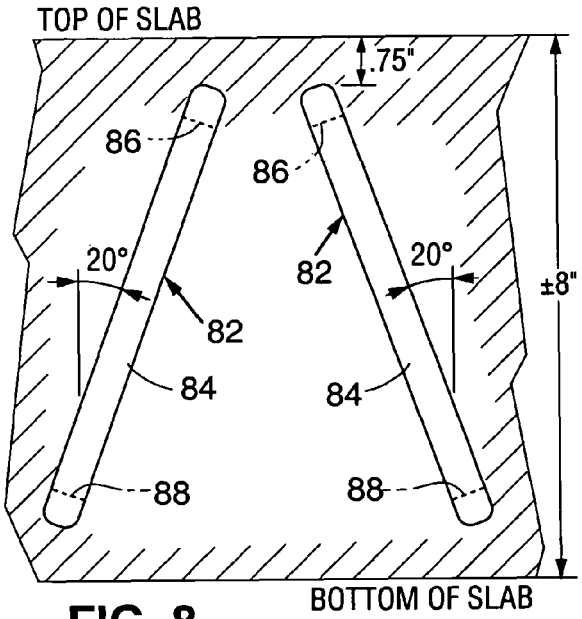
FIG. 8 is a side elevational view of the anchor shown in FIG. 7.
Figure 9:
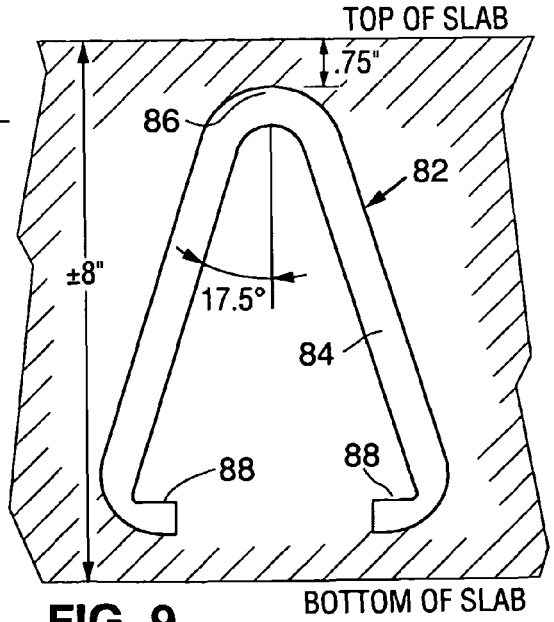
FIG. 9 is a front elevational view of one of the anchors shown in FIG. 7.

FIGS. 7 to 9 illustrate an alternative pair of anchors which may be used in place of the anchors 40, 42. These alternative anchors are made of bar or wire stock and are particularly well adapted for use in relatively thin concrete slabs to better spread lifting loads through the mass of the concrete. Each anchor, designated 82, is of a generally v-shaped configuration having a pair of divergent legs 84 defining a clevis 86 at their joinder. The legs terminate in inwardly bent distal ends 88.

The preferred dimensions and angles of divergence for the anchors 82, when placed within a concrete slab, are shown in FIGS. 8 and 9. These dimensions and angles, together with the provision of the inwardly extending distal ends 88, provide for optimum resistance to pull out by maintaining a large body of concrete under compression, as lifting forces are applied to the anchors.

Figure 6:
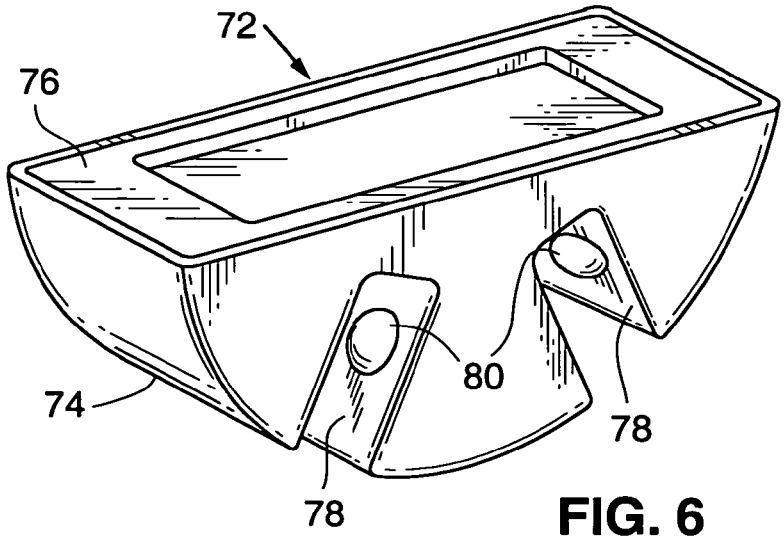
FIG. 6 is a perspective view of the void former, without anchors in place.

In use, the anchors 82 are positioned relative to the lifting shackle in essentially the same relationship shown in FIGS. 2 and 3, with regard to the anchors 40, 42. The principal difference is the inward surfaces of the devises 86 provide the apertures through which the locking bolt 64 is extended. Void formers, similar to that of FIGS. 4 and 6, may be provided for initial placement of the anchors 82.

CONCLUSION

From the foregoing description, it should be apparent that the present invention provides for the attainment of the objects initially set forth herein. In particular, it provides a dual anchor lifting shackle and an improved apparatus and method for placing multiple anchors within a concrete structure and lifting the structure through a common shackle simultaneously engagable with the anchors. It should be understood, however, that the invention is not limited to the specifics which have been described and illustrated, but rather is defined by the accompanying claims.

The invention claimed is:

1. A concrete structure and lifting mechanism therefor, comprising:

a. an arcuate recess formed in the surface of the concrete structure;

b. a pair of anchors embedded within the structure and extending across the recess in spaced relationship to one another, said anchors diverging outwardly relative to one another and defining annularly aligned openings disposed within the recess;

c. a ring-shaped shackle having a hollow toroidal portion complimental with and received within the groove, said toroidal portion having slots extending thereacross into which the anchors extend, said slots having convergent outer surfaces complimentally engaged with the anchors and inner surfaces which diverge relative to the outer surfaces of the slots to enable the anchors to move into and out of the slots in a generally rectilinear path; and, d. an arcuate locking bolt slidably received within the toroidal portion of the body for select extension across the slots and through the annularly aligned openings defined by the anchors.

2. A concrete structure and lifting mechanism according to claim 1 wherein each slot terminates within the shackle to provide a socket which complimentally receives an end portion of the anchor received within the slot.

3. A concrete structure and lifting mechanism according to claim 1 wherein the outer surfaces of the respective slots converge relative to the inner surfaces of the slots at an angle of between 10 and 35 degrees.

4. A concrete structure and lifting mechanism according to claim 3 wherein the inner surfaces of the respective slots are generally parallel to one another.

5. A hoisting shackle for lifting a concrete structure, said shackle comprising:

a. a ring-shaped body having a hollow toroidal portion with slots extending thereacross in convergent relationship at annularly spaced locations for the receipt of spaced divergent anchors cast in place within the concrete structure; and, b. an arcuate locking bolt slidably received within the toroidal portion of the body for select extension across the slots and through anchors received within the slots.

6. A hoisting shackle according to claim 5, wherein the slots have outer surfaces convergent relative to one another and inner surfaces which diverge relative to the outer surfaces to enable convergent ends of the divergent anchors extending from the concrete structure to move into and out of the slots in a generally rectilinear path.

7. A concrete structure and lifting mechanism therefor, comprising:

a. an arcuate recess formed in the surface of the concrete structure;

b. a pair of anchors embedded within the structure and extending across the recess in spaced relationship to one another, said anchors converging relative to one another and defining annularly aligned openings disposed within the recess;

c. a ring-shaped shackle having a hollow toroidal portion complimental with and received within the groove, said toroidal portion having spaced slots extending thereacross into which the anchors extend, said slots having convergent outer surfaces complimentally engaged with the anchors therein; and, d. an arcuate locking bolt slidably received within the toroidal portion of the body for select extension across the slots and through the annularly aligned openings defined by the anchors.

8. A method for providing for the lifting of a concrete structure, said method comprising:

a. forming an arcuate recess in the structure;

b. embedding two or more anchors within the structure in divergent relationship to one another with end portions of the anchors extending into the recess and defining annularly aligned openings disposed within the recess;

c. providing a ring-shaped shackle having a hollow toroidal portion complimental with and received within the recess, said toroidal portion having slots extending thereacross into which the anchors extend; and, d. extending an arcuate locking bolt through the toroidal portion and the annularly aligned openings defined by the anchors.

* * * * *